US006155242A

United States Patent [19]

Kotwicki et al.

[11] Patent Number: 6,155,242

[45] Date of Patent: Dec. 5, 2000

[54] AIR/FUEL RATIO CONTROL SYSTEM AND METHOD

[75] Inventors: Allan Joseph Kotwicki, Williamsburg; John David Russell, Farmington Hills, both of Mich.

[73] Assignee: Ford Global Technologies, Inc., Dearborn, Mich.

[21] Appl. No.: 09/296,184

[22] Filed: Apr. 26, 1999

[51] Int. Cl.[7] ..... F02D 41/18

[52] U.S. Cl. ..... 123/704; 123/681; 701/104

[58] Field of Search ..... 123/704, 681, 123/478, 480; 701/104; 73/118.2

[56] References Cited

U.S. PATENT DOCUMENTS 4,499,881 2/1985 Takao .
4,712,529 12/1987 Terasaka et al. .
4,870,937 10/1989 Sanbuichi et al. .
5,069,184 12/1991 Kato et al. .
5,094,213 3/1992 Dudek et al. ..... 123/478
5,159,914 11/1992 Follmer et al. ..... 123/478
5,273,019 12/1993 Matthews et al. ..... 123/478
5,274,559 12/1993 Takahashi et al. ..... 123/480
5,293,553 3/1994 Dudek et al. ..... 123/480
5,423,208 6/1995 Dudek et al. ..... 123/478
5,597,951 1/1997 Yoshizaki et al. ..... 73/118.2
5,974,870 11/1999 Treinies et al. ..... 73/118.2

*Primary Examiner*—Erick Solis
*Attorney, Agent, or Firm*—John D. Russell

[57] ABSTRACT

An air/fuel ratio control method for an internal combustion engine corrects airflow prediction errors. The method compares the current airflow to the value that was predicted several events in the past and creates an error signal. Based on this error signal, the current fueling is adjusted. These two mixtures, with equally offsetting lean and rich air/fuel ratios allow the catalytic converter to operate at peak efficiency despite prediction errors.

19 Claims, 4 Drawing Sheets

AIR/FUEL RATIO CONTROL SYSTEM AND METHOD

FIELD OF THE INVENTION

The invention relates to air/fuel ratio control of an internal combustion engine where an air quantity entering a cylinder of the engine is predicted.

BACKGROUND OF THE INVENTION

Engine control systems inject fuel into the engine to maintain a desired air/fuel ratio necessary for controlling regulated emissions. In certain applications, the amount of fuel injected is based on an estimate of air entering the cylinder to maintain a desired air fuel ratio. The estimate of air entering the cylinder is based on a measurement of airflow entering the intake manifold of the engine. In addition, other parameters such as engine speed are utilized.

Because injecting fuel takes a finite amount of time and, in certain cases, fuel is injected before the air actually enters the cylinder, the actual amount of air that enters the cylinder is different from that which was estimated and used in the calculation of the fuel injection amount. For example, engine operating parameters, such as throttle position, can change between the time when the estimate was made and fuel injection amount calculated and the time when the fuel was actually injected. Thus, an error in the air fuel ratio results.

One method of improving air/fuel ratio control is to predict a future value of air entering the cylinder (or a future value of manifold pressure) and then use this prediction to calculate the fuel injection amount. The prediction is based on the current operating conditions and various models representing the physical processes of the internal combustion systems. Such a system is disclosed in U.S. Pat. No. 5,069,184.

The inventors herein have recognized a disadvantage with the above approach. For example, the approach attempts to predict the future value of air entering the cylinder. Thus, there will always be an error because perfect prediction is not possible. The prediction error will translate directly to an error in the air/fuel ratio, thereby affected the production of regulated emissions.

SUMMARY OF THE INVENTION

An object of the invention claimed herein is to provide an air/fuel ratio control system for an internal combustion engine insensitive to errors in predicting air entering the cylinder.

The above object is achieved, and problems of prior approaches overcome, by a method for controlling an air/fuel ratio in a cylinder of an internal combustion engine, said engine coupled to an emission control device. The method comprises, at a first sample index, estimating an air quantity inducted into the cylinder during a second sample index which follows said first sample index; at said second sample index calculating an actual air quantity inducted into the cylinder during said second sample index; and adjusting a fuel injection quantity based on said estimated air quantity and said actual air quantity to reduce an increase in emissions from the emission control device which would otherwise occur.

By calculating estimated and actual air entering the cylinder, and using this to correct fuel injection, it is possible to exploit the exhaust gas mixing in the exhaust manifold and the inherent storage in the catalytic converter. These processes, in combination with the present invention, allow past fueling errors due to prediction error to be corrected. Thus, the present invention will intentionally inject a lean mixture if a rich mixture was previously unintentionally injected. Then, using the exhaust mixing and catalyst storage properties, the lean and rich mixtures nullify each other in the catalytic converter and regulated emissions are minimized.

An advantage of the present invention is the ability to operate the catalytic converter at peak efficiency.

Another advantage of the present invention is the ability to reduce regulated emissions.

Other objects, features and advantages of the present invention will be readily appreciated by the reader of this specification.

BRIEF DESCRIPTION OF THE DRAWINGS

The objects and advantages described herein will be more fully understood by reading an example of an embodiment in which the invention is used to advantage, referred to herein as the Description of Preferred Embodiment, with reference to the drawings, wherein.

DESCRIPTION OF PREFERRED EMBODIMENT

Figure 1:
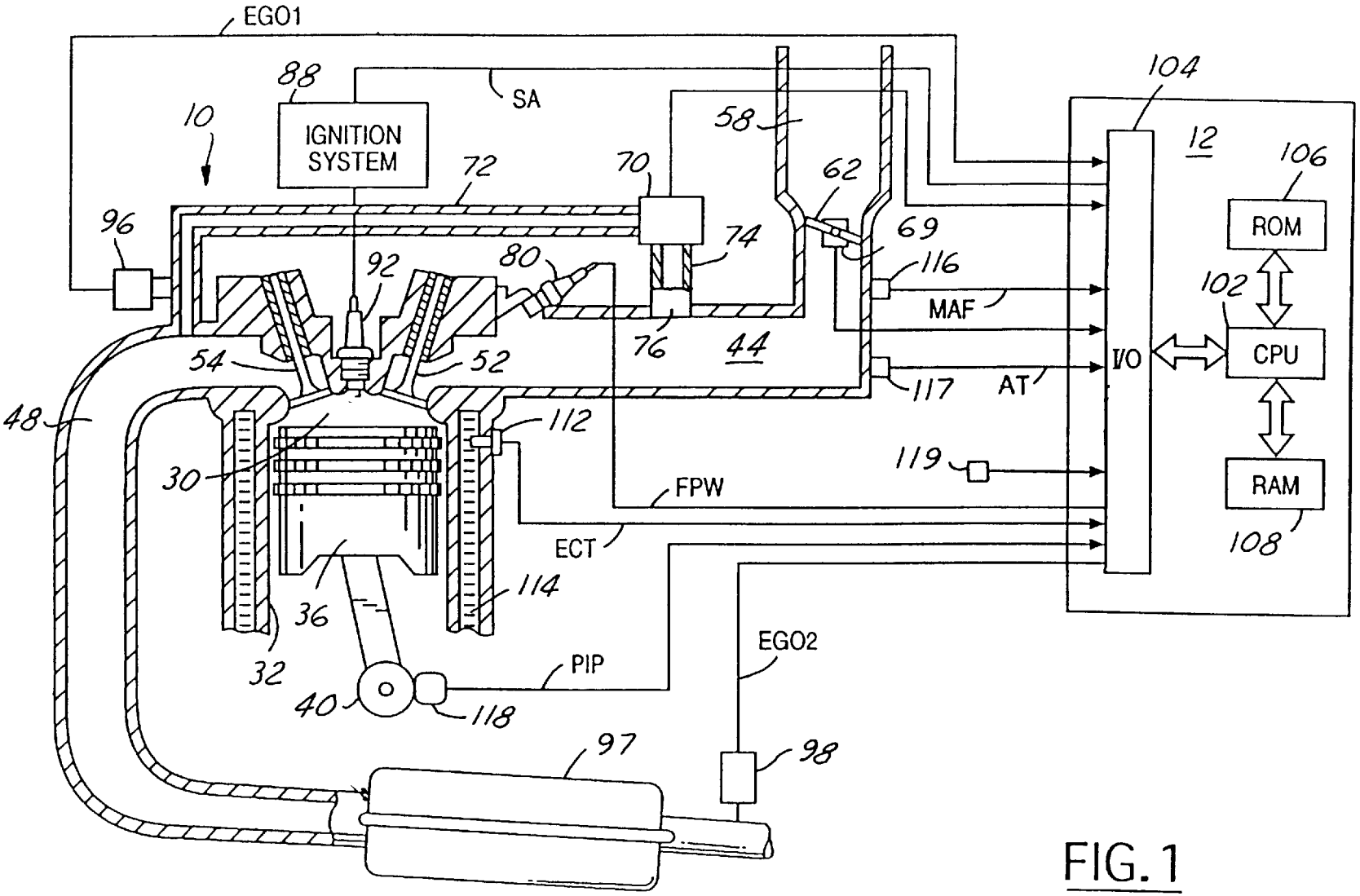
FIG. 1 is a block diagram of an embodiment wherein the invention is used to advantage.

Internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is known communicating with intake manifold 44 and exhaust manifold 48 via respective intake valve 52 and exhaust valve 54. Intake manifold 44 is shown communicating with throttle body 58 via throttle plate 62. Throttle position sensor 69 measures position of throttle plate 62. Exhaust manifold 48 is shown coupled to exhaust gas recirculation valve 76 via exhaust gas recirculation tube 72 having exhaust gas flow sensor 70 therein for measuring an exhaust gas flow quantity. Exhaust gas recirculation valve 76 is also coupled to intake manifold 44 via orifice tube 74. Intake manifold 44 is also shown having fuel injector 80 coupled thereto for delivering liquid fuel in proportion to the pulse width of signal FPW from controller 12. Fuel is delivered to fuel injector 80 by a conventional fuel system (not shown) including a fuel tank, fuel pump, and fuel rail (not shown). Alternatively, the engine may be configured such that the fuel is injected directly into the cylinder of the engine, which is known to those skilled in the art as a direct injection engine.

Conventional distributorless ignition system 88 provides ignition spark to combustion chamber 30 via spark plug 92 in response to controller 12. Two-state exhaust gas oxygen sensor 96 is shown coupled to exhaust manifold 48 upstream of catalytic converter 97. Two-state exhaust gas oxygen sensor 98 is shown coupled to exhaust manifold 48 downstream of catalytic converter 97. Sensor 96 provides signal EGO1 to controller 12 which converts signal EGO1 into two-state signal EGO1S. A high voltage state of signal EGO1S indicates exhaust gases are rich of a reference air/fuel ratio and a low voltage state of converted signal EGO1 indicates exhaust gases are lean of the reference air/fuel ratio. Sensor 98 provides signal EGO2 to controller 12 which converts signal EGO2 into two-state signal EGO2S. A high voltage state of signal EGO2S indicates exhaust gases are rich of a reference air/fuel ratio and a low voltage state of converted signal EGO2S indicates exhaust gases are lean of the reference air/fuel ratio.

Controller 12 is shown in FIG. 1 as a conventional microcomputer including: microprocessor unit 102, input/output ports 104, read-only memory 106, random access memory 108, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a measurement of mass air flow measurement (MAF) from mass flow sensor 116 coupled to intake manifold 44; a measurement (MT) of manifold temperature from temperature sensor 117; a profile ignition pickup signal (PIP) from Hall effect sensor 118 coupled to crankshaft 40, and an engine speed signal (RPM) from engine speed sensor 119. In a preferred aspect of the present invention, engine speed sensor 119 produces a predetermined number of equally spaced pulses every revolution of the crankshaft.

Figure 2:
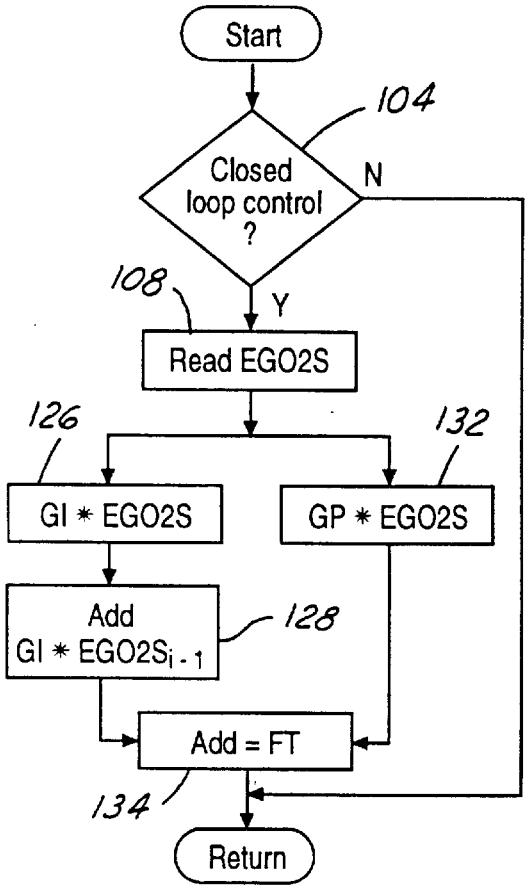
FIGS. 2–4 are high level flow charts of various operations performed by a portion of the embodiment shown in FIG. 1.

Referring now to FIG. 2, a flowchart of a routine performed by controller 12 to generate fuel trim signal FT is now described. A determination is first made whether closed-loop air/fuel control is to be commenced (step 122) by monitoring engine operation conditions such as temperature. When closed-loop control commences, signal EGO2S is read from sensor 98 (step 124) and subsequently processed in a proportional plus integral controller as described below.

Referring first to step 126, signal EGO2S is multiplied by gain constant GI and the resulting product added to products previously accumulated ($GI*EGO2S_{i-1}$) in step 128. Stated another way, signal EGO2S is integrated each sample period (i) in steps determined by gain constant GI. During step 132, signal EGO2S is also multiplied by proportional gain GP. The integral value from step 128 is added to the proportional value from step 132 during addition step 134 to generate fuel trim signal FT.

Figure 3:
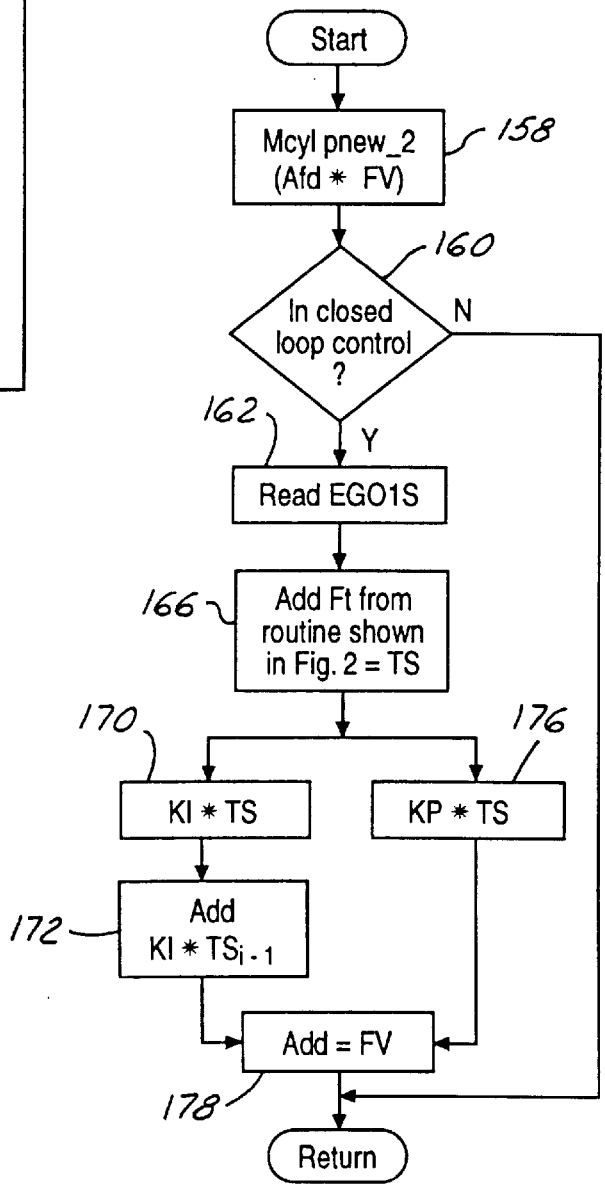

The routine executed by controller 12 to generate the desired quantity of liquid fuel delivered to engine 10 and trimming this desired fuel quantity by a feedback variable related both to sensor 98 and fuel trim signal FT is now described with reference to FIG. 3. During step 158, an open-loop fuel quantity is first determined by dividing the estimated air entering the cylinder for a predicted cylinder (Mcylpnew as described later herein with particular reference to FIG. 4), by desired air/fuel ratio Afd, which is typically the stoichiometric value for gasoline combustion. However, setting AFd to a rich value will result in operating the engine in a rich state. Similarly, setting AFd to a lean value will result in operating the engine in a lean state. This open-loop fuel quantity is then adjusted, in this example divided, by feedback variable FV.

After determination that closed-loop control is desired (step 160) by monitoring engine operating conditions such as temperature (ECT), signal EGO1S is read during step 162. During step 166, fuel trim signal FT is transferred from the routine previously described with reference to FIG. 2 and added to signal EGO1S to generate trim signal TS.

During steps 170–178, a proportional plus integral feedback routine is executed with trimmed signal TS as the input. Trim signal TS is first multiplied by integral gain value KI (step 170), and the resulting product added to the previously accumulated products (step 172). That is, trim signal TS is integrated in steps determined by gain constant KI each sample period (i) during step 172. A product of proportional gain KP times trimmed signal TS (step 176) is then added to the integration of KI*TS during step 178 to generate feedback variable FV.

Figure 4:
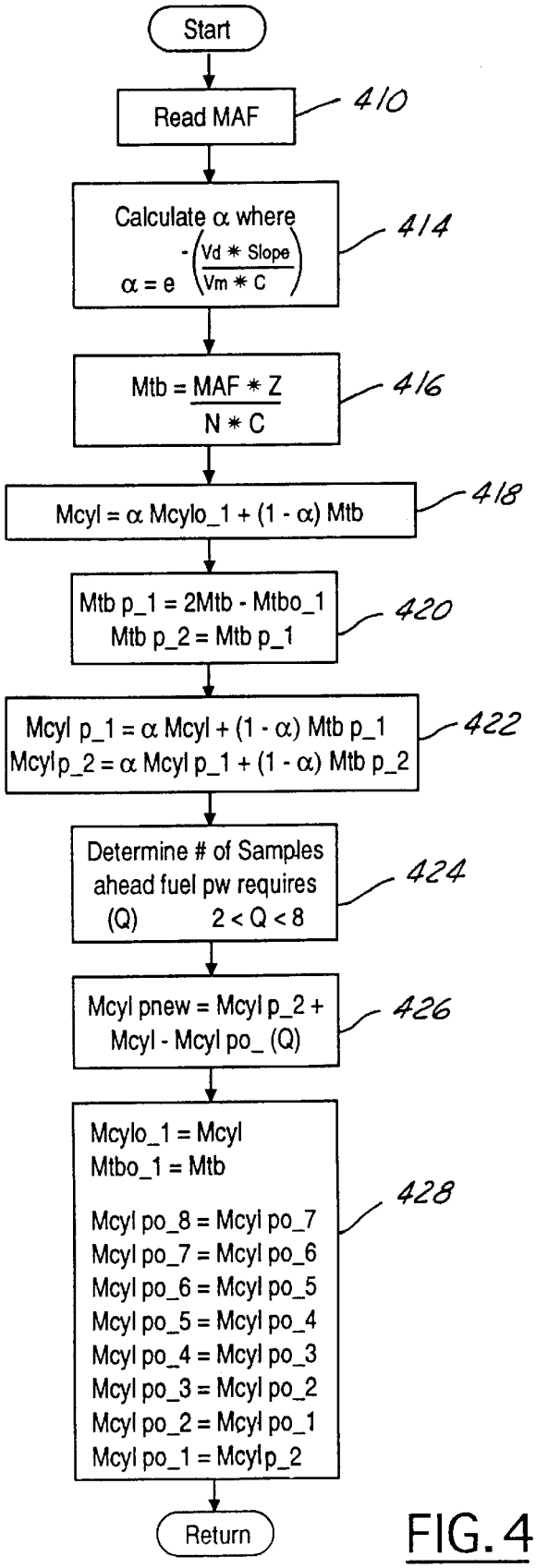

According to the present invention, referring now to FIG. 4, a flowchart of a routine performed by controller 12 to estimate the quantity of air entering the cylinder is described. The routine is executed at constant intervals of engine rotation to simplify calculations. For example, airflow measurement is simplified because of airflow pulsations that occur synchronously with the sampling interval. In step 410, the value of mass air flow sensor (MAF) 116 is read. As is known to those skilled in the art, signal MAF is also used to represent an engine load during stociometric conditions. Then, in step 414, the filter parameter (a) is determined by the following function:

$$\alpha = e^{-(Vd*slope)/(Vm*C)}$$

where e is the exponential function, slope is the single calibratable parameter representing the slope of the graph between manifold pressure and cylinder air charge, and the following are all constant: Vd is the engine displacement volume, Vm is the manifold volume, and C is the number of cylinders.

A simplified function that approximates the expression shown above may also be used as is obvious to one of ordinary skill in the art and suggested by this disclosure. Also, if the routine is not executed at constant engine rotational intervals, the filter parameter would be calculated by the following function, where T is the sample time:

$$\alpha = e^{-(Vd*slope*T)/(N*Vm*C)}$$

Next, in step 416, the current air entering the manifold, mtb is calculated by multiplying MAF by 2 then dividing by the engine speed (N) and the number of cylinders (C). Then, in step 418, the current estimated value of the air entering the cylinder (Mcyl) is calculated using the filter parameter ($\alpha$), the previous value of the air entering the cylinder one event in the past (Mcylo_1) and the current air entering the manifold (mtb), where event refers to combustion event. Next, in step 420, a prediction is made of the airflow entering the manifold one step in the future (mtbp_1) based on the current airflow entering the manifold (mtb) and the previous value of airflow entering the manifold one event in the past (mtbo_1). A prediction is also made of the airflow entering the manifold two events in the future (mtbp_2) as being equal to mtbo_1. This is just one method for predicting airflow into the manifold in the future. Any method known to those skilled in the art and suggested by this disclosure could be used to perform this prediction. Any prediction method is suitable to be used to advantage according to the present invention.

Referring now to step 422, the predicted airflows entering the manifold (mtbp_1, mtbp_0) are used with the current airflow entering the cylinder (mcyl) to predict the air entering the cylinder at one and two events in the future. This is just one method for predicting airflow into the cylinder in the future. Again, any method known to those skilled in the art and suggested by this disclosure could be used to perform this prediction. Any prediction method is suitable to be used to advantage according to the present invention.

Referring now to step 424, a determination is made as to the number of events in the future (Q) for which the fuel pulse width (fpw) is calculated, where events again refers to combustion events. This is a function of engine speed and reflects the amount time an injector must be opened to allow the necessary fuel quantity to be injected. As engine speed increases, the fuel injection time must be scheduled earlier. This function can be found experimentally or analytically based on the fuel injector characteristics and required fuel injection quantity. A typical value for a V–8 engine is two events. Thus, the fuel amount being calculated by the engine controller will be injected into the cylinder that will fire two combustion events in the future. Thus, the prediction of two events directly matches this value. However, in some instances, the value of Q can be as large as 8.

Referring now to step 426, the prediction of airflow entering the cylinder two events in the future (mcylp_2) is modified based on an error signal (e). The error signal represents the fuel error caused by previous predictions of the airflow entering the cylinder that did not match the actual airflow entering the cylinder. This error is known because the previous predictions can be compared with the airflow entering the cylinder based on non-predicted (current) measurements. The modified airflow (mcylpnew) is determined based on the predicted value of airlflow entering the cylinder (mcylp_2), the current airflow entering the cylinder (mcyl) and the predicted airflow entering the cylinder to which the current airflow entering the cylinder (mcyl) corresponds. For example, if Q=2, then:

mcylpnew=mcylp_2+mcyl−mcylpo_2 where, mcylpo_2 represents the predicted airflow (that was predicted 2 events in the past) that should have matched the current value of mcyl. If, for example, Q=3, then:

mcylpnew=mcylp_2+mcyl−mcylpo_3 where, mcylpo_3 represents the predicted airflow (that was predicted 3 events in the past) that should have matched the current value of mcyl.

Referring now to step 428, past values are saved in memory for future use as described above herein.

Figure 5:
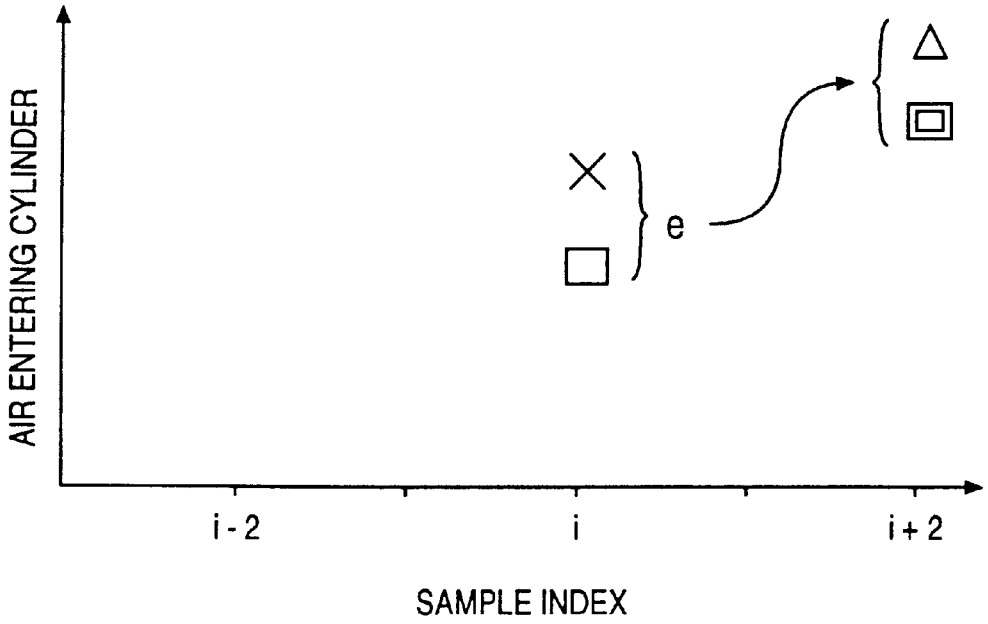
FIG. 5 is a graph illustrating application of the present invention.

Referring now to FIG. 5, a graph illustrating application of the present invention is shown. The graph shows how the present invention operates at generic sample index when the value of Q=2. At generic sample index (i), the square represents the predicted air entering the manifold that was predicted at generic sample index (i−2). This value was used to calculate the fuel that was injected into the cylinder firing at generic sample index (i). However, at generic sample index (i), the current measurements processed as described above herein with particular reference to FIG. 4, give an actual value of air entering the cylinder represented by the cross. This means that an error (e) was made in the fueling operation and since this cylinder is currently firing, it is too late to correct this error in the firing cylinder.

However, according to the present invention, this error is used to correct the next possible cylinder firing, assuming that the gasses for both cylinders will mix in an exhaust volume and enter a common catalytic converter. As shown in FIG. 5 by the double square, at generic sample index (i), a prediction is made as to the air entering the cylinder that will fire at generic sample index (i+2) as described above herein with particular reference to FIG. 4. Then, this prediction is augmented with the error (e) to form a new value used for fueling as shown by the triangle. In this way, past prediction errors can be corrected for and improvements in tailpipe emissions can be realized.

Although several examples of embodiments which practice the invention have been described herein, there are numerous other examples which could also be described. For example, the invention may be used to advantage with carbureted engines, proportional exhaust gas oxygen sensors, and engines having an in-line configuration rather than a V-configuration. Further, if there are multiple cylinder banks in which the exhaust gases from the respective banks do not mix before a catalyst, then fueling error must be corrected on a per bank basis.

Also, when operating on a direct injection type internal combustion engine, the number of events into the future for which the prediction must be made is reduced because, in stratified operation, some fuel is directed during the compression stroke of the engine, while some is injected during the intake stroke. The number of events is reduced because there is less of a delay between airflow calculation and intake valve closing.

The invention is therefore to be defined only in accordance with the following claims.

We claim:

1. A method for controlling an internal combustion engine coupled to an emission control device, the method comprising:

at a first sample index, predicting a value of an engine operating parameter occurring during a second sample index;

injecting a first fuel amount into the engine based on said predicted value;

determining whether said first injected fuel amount resulted in an inadvertent air/fuel ratio error; and offsetting said air/fuel ratio error by injecting a second fuel amount at an index after said first index based on an actual value of said engine operating parameter.

2. The method recited in clam 1, wherein said engine operating parameter is an air quantity inducted into the engine.

3. The method recited in clam 1, wherein said sample indices represent cylinder firing events.

4. The method recited in clam 3, wherein said second sample index occurs at predetermined number of cylinder firing events after said first sample index.

5. The method recited in clam 4, wherein said predetermined number of cylinder firing events is adjusted based on engine operating conditions.

6. The method recited in claim 5, wherein said engine operating conditions comprise an engine speed and load.

7. The method recited in clam 4, wherein said predetermined number of cylinder events is decreased when the engine is operating in the stratified mode.

8. The method recited in clam 1, wherein said first injected fuel amount forms a first air/fuel mixture, and said second injected fuel amount forms a second air/fuel mixture, and said first air/fuel mixture and said second air/fuel mixture meet to form a third air/fuel mixture which enters the emission control device.

9. A method for controlling an internal combustion engine having a first group of at least one cylinder coupled to a first emission control device and a second group of at least one cylinder coupled to a second emission control device, the method comprising:

at a first sample index, predicting an air induction amount entering one of said first and second cylinder groups during a second sample index occurring after said first sample index;

injecting a first fuel amount into said one of said first and second cylinder groups based on said predicted value;

determining whether said first injected fuel amount resulted in an inadvertent air/fuel ratio error in said one of said first and second cylinder groups; and offsetting said air/fuel ratio error by injecting a second fuel amount into said one of said first and second cylinder groups at an index after said first index based on an actual air induction amount entering said one of said first and second cylinder groups.

10. The method recited in claim 9, wherein said sample indices represent cylinder firing events.

11. The method recited in claim 10, wherein said second sample index occurs a predetermined number of cylinder events after said first sample index.

12. The method recited in claim 11, wherein said predetermined number of cylinder firing events is adjusted based on engine operating conditions.

13. The method recited in claim 12, wherein said engine operating conditions comprise an engine speed and load.

14. The method recited in claim 9, wherein said first injected fuel amount is injected into a first cylinder of said one of said first and second cylinder groups, and said second injected fuel amount is injected into a second cylinder of said one of said first and second cylinder groups.

15. The method recited in claim 11, wherein said predetermined number of cylinder firing events is decreased when operating the engine in a stratified mode.

16. The method recited in claim 9, wherein said emission control device is a catalytic converter.

17. The method recited in claim 9, wherein said step of injecting said first fuel amount into said one of said first and second cylinder groups based on said predicted value further comprising adjusting said first injected fuel amount based on a signal from an exhaust sensor coupled to the engine.

18. A method for controlling an internal combustion engine coupled to an emission control device, the method comprising:

at a first sample index, predicting a value of an engine operating parameter occurring during a second sample index;

injecting fuel into the engine based on said predicted value;

determining whether said injected fuel resulted in an inadvertent lean air/fuel ratio, or an inadvertent rich air/fuel ratio; and offsetting said inadvertent lean or rich air/fuel ratio by intentionally injecting a rich air/fuel mixture at an index after said first index if said inadvertent lean air/fuel ratio occurred, or intentionally injecting a lean air/fuel mixture at said index after said first index if said inadvertent rich air/fuel ratio occurred.

19. The method recited in claim 18, wherein said engine operating parameter is an air induction amount.

* * * * *